US006688847B2

(12) United States Patent
Oya et al.

(10) Patent No.: US 6,688,847 B2
(45) Date of Patent: Feb. 10, 2004

(54) SHAFT STRUCTURE AND BEARING STRUCTURE FOR TAIL END OF ROTOR OF GAS TURBINE

(75) Inventors: Takeaki Oya, Takasago (JP); Kazuharu Hirokawa, Takasago (JP); Tadateru Tanioka, Takasago (JP); Tanehiro Shinohara, Takasago (JP); Katsunori Tanaka, Takasago (JP); Kazuo Uematsu, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 138 days.

(21) Appl. No.: 09/942,619

(22) Filed: Aug. 31, 2001

(65) Prior Publication Data

US 2002/0037216 A1 Mar. 28, 2002

(30) Foreign Application Priority Data

Sep. 26, 2000 (JP) ..... 2000-292763

(51) Int. Cl.[7] ..... F01D 5/08; F01D 5/18
(52) U.S. Cl. ..... 416/96 R; 415/180
(58) Field of Search ..... 415/180, 116, 415/115; 416/96 R

(56) References Cited

U.S. PATENT DOCUMENTS 6,293,089 B1 * 9/2001 Sasaki ..... 60/806
6,450,758 B1 * 9/2002 Schmidt ..... 415/115

FOREIGN PATENT DOCUMENTS

| | | |
|---|---|---|
| EP | 0 894 942 A2 | 2/1999 |
| EP | 0 936 350 A2 | 8/1999 |
| EP | 1 010 858 A2 | 6/2000 |
| EP | 1 013 895 A2 | 6/2000 |
| EP | 1 013 895 | 6/2000 |
| JP | 03253726 | 12/1991 |
| JP | 2000-192803 | 7/2000 |

* cited by examiner

*Primary Examiner*—Edward K. Look
*Assistant Examiner*—Kimya N McCoy
(74) *Attorney, Agent, or Firm*—Oblon, Spivak, McClelland, Maier & Neustadt, P.C.

(57) ABSTRACT

A shaft structure of a rotor tail end of a gas turbine in which a steam passage for supplying and recovering a steam for cooling rotor blades of the gas turbine extends along a center axis of the rotor assembly of the gas turbine is provided, wherein a center hole of the rotor tail end coaxial to the center axis of the steam passage is formed in the rotor tail end. Provision is also made of a thermal sleeve between the steam passage and the inner surface of the center hole of the rotor tail end, so that a thermal insulation gas layer is formed between the inner surface of the center hole of the rotor tail end and the thermal sleeve. The thermal insulation gas layer is isolated gas-tightly and liquid-tightly from the outside.

10 Claims, 12 Drawing Sheets

SHAFT STRUCTURE AND BEARING STRUCTURE FOR TAIL END OF ROTOR OF GAS TURBINE

BACKGROUND OF THE INVENTION

1. Field of the Invention

The present invention relates to prevention or restriction of thermal deformation of a rotor tail end of a steam-cooled gas turbine.

2. Description of the Related Art

The temperature of the burnt gas at an inlet of a gas turbine has been increasing to increase the efficiency of the gas turbine, and in recent years, a gas turbine in which the temperature reaches 1500° C. has been proposed.

A so-called steam-cooled gas turbine, in which the relatively low temperature of steam is used as a coolant, to protect stator blades and rotor blades of the gas turbine from the burnt gas of high temperature, in place of a conventional air cooling system, is being developed. To cool the rotor blades of the gas turbine by steam, it is necessary to provide steam passages for supplying and recovering the cooling steam for the rotor blades, along the center axis of the rotor of the gas turbine.

A rotor assembly of a gas turbine having a plurality of rotor disks which are fastened to each other by spindle bolts so as to rotate together is rotatably supported by a journal bearing. Since the rotor assembly of the gas turbine is very heavy, the gap between the shaft portion of the rotor assembly and the journal bearing is very precisely administrated. However, in the steam-cooled gas turbine, the steam passes through the center portion of the rotor assembly and, hence, the latter and in particularly its shaft portion is thermally deformed, so that the journal bearing can be damaged.

It is an object of the present invention to eliminate these problems, by providing a shaft structure and bearing structure, for a rotor tail end of a steam-cooled gas turbine, in which little or no thermal deformation of the rotor tail end of the gas turbine occurs.

SUMMARY OF THE INVENTION

According to an aspect of the present invention, there is provided a shaft structure of a rotor tail end of a gas turbine in which a steam passage for supplying and recovering a steam for cooling rotor blades of the gas turbine extends along a center axis of the rotor assembly of the gas turbine, wherein a center hole of the rotor tail end coaxial to the center axis of the steam passage is formed in the rotor tail end; a thermal sleeve is provided between the steam passage and the inner surface of the center hole of the rotor tail end; a thermal insulation gas layer is formed between the inner surface of the center hole of the rotor tail end and the thermal sleeve; and the thermal insulation gas layer is isolated gas-tightly and liquid-tightly from the outside.

According to this embodiment of the invention, a thermal sleeve is provided between the steam passage and the inner surface of the center hole of the rotor tail end, so that a thermal insulation gas layer is formed between the inner surface of the center hole and the thermal sleeve. Consequently, when the steam for cooling the turbine rotor blades passes in the steam passage, the heat transfer to the vicinity of the surface of the shaft portion is restricted, thus resulting in little or no thermal deformation of the shaft portion. Moreover, the thermal insulation gas layer is gas-tightly or liquid-tightly isolated from the outside, no steam enters the thermal insulation gas layer. Therefore, if the temperature drops during the stoppage of the gas turbine, no drain of the steam due to the condensation thereof occurs. Thus, no abnormal vibration due to the drain of the steam takes place.

The thermal sleeve can be in the form of a substantially circular cylinder which is welded at its one end to an end disk of the gas turbine and welded at the other end to a shaft portion of the rotor tail end. The thermal sleeve can be provided with a bent portion in the vicinity of the end thereof welded to the shaft portion of the rotor tail end. Consequently, if a temperature difference is caused between the thermal sleeve and the shaft portion, due to the steam passing in the steam passage, the bent portion absorbs the thermal expansion in the axial direction due to the temperature difference to thereby prevent the thermal sleeve from being damaged or broken.

When the thermal sleeve is welded to the end disk or the shaft portion, a pre-tension is preferably applied to the thermal sleeve. The welding of the pre-tensed thermal sleeve to the shaft portion prevents the occurrence of thermal deformation of the thermal sleeve. Moreover, the bent portion and the application of the pre-tension contributes, in combination, to further restriction of the thermal deformation of the thermal sleeve and to a prevention of the thermal sleeve from being damaged or broken.

In another embodiment of the invention, a shaft structure of a rotor tail end of a gas turbine in which a steam passage for supplying and recovering a steam for cooling rotor blades of the gas turbine extends along a center axis of the rotor assembly of the gas turbine, comprises a plurality of shaft portion cooling air passages formed between the steam passage and an outer surface of a shaft portion of the rotor tail end.

According to the embodiment, a plurality of the shaft portion cooling air passages are formed between the steam passage and the outer surface of the shaft portion of the rotor tail end, so that the cooling air passes in the shaft portion cooling air passages. Consequently, when the steam for cooling the turbine rotor blades passes in the steam passage, the shaft portion is cooled by the cooling air passing in the shaft portion cooling air passages, so that the thermal deformation of the shaft portion can be reduced or restricted.

The shaft portion cooling air passages are at least partly formed by directly drilling the shaft portion. Alternatively, the shaft portion can be comprised of a shaft body portion which surrounds the steam passage, and a sleeve fitted on an outer surface of the shaft body portion, so that the shaft portion cooling air passages can be formed at least partly between the shaft body portion and the sleeve.

According to another aspect of the present invention, there is provided a bearing structure for bearing a shaft portion of a rotor tail end of a gas turbine in which a steam passage for supplying and recovering a steam for cooling rotor blades of the gas turbine extends along a center axis of the rotor assembly of the gas turbine, comprising a bearing pad which forms a journal bearing, and seal portions provided on opposite sides of the bearing pad in the axial direction to prevent leakage of a lubricant for lubricating a space between the bearing pad and the shaft portion, the width of the seal portion in the axial direction being such that the surface temperature of the shaft portion of the rotor tail end is maintained below a predetermined temperature by the lubricant, within the width of the bearing pad in the axial direction.

In the bearing structure of the rotor tail end of a gas turbine, since the seal portions provided on opposite sides of the bearing pad are made longer in the axial direction than that of the conventional seal portions, the lubricant supplied to a space between the shaft portion of the rotor tail end and the bearing pad can be spread over a broader surface area of the shaft portion in the axial direction. Consequently, a broader surface area of the shaft portion in the axial direction can be cooled by the lubricant, so that it is possible to maintain the surface temperature of the portion of the shaft portion that is opposed to the bearing pad, at a temperature below a predetermined value. Consequently, it is possible to restrict the thermal deformation, and particularly, the thermal expansion of the shaft portion in the radial direction, at the outer surface portion of the shaft portion that is opposed to the bearing pad, within an allowable limit.

According to another aspect of the present invention, there is provided a shaft structure of a rotor tail end of a gas turbine in which a steam passage for supplying and recovering a steam for cooling rotor blades of the gas turbine extends along a center axis of the rotor assembly of the gas turbine, wherein said rotor tail end is provided therein with a center hole coaxial to the center axis of the steam passage; a thermal sleeve is provided between the steam passage and the inner surface of the center hole of the rotor tail end; a thermal insulation gas layer is formed between the inner surface of the center hole of the rotor tail end and the thermal sleeve; and cooling air is circulated from the outside into the thermal insulation gas layer to enhance the cooling effect of the rotor.

According to another embodiment of the present invention, the thermal sleeve is in the form of a substantially circular cylinder which is welded at its one end to an end disk of the gas turbine and is welded at the other end to a shaft portion of the rotor tail end through a bellows which reduces a thermal stress due to a thermal expansion of the thermal sleeve.

According to another aspect of the present invention, there is provided a shaft structure of a rotor tail end of a gas turbine in which a steam passage for supplying and recovering a steam for cooling rotor blades of the gas turbine extends along a center axis of the rotor assembly of the gas turbine, wherein the rotor tail end is provided therein with a center hole coaxial to the center axis of the steam passage; a steam pipe is provided in the center hole of the rotor tail end; a thermal insulation gas layer is formed between the inner surface of the center hole of the rotor tail end and the steam pipe; and the steam pipe is connected to a stationary steam pipe through seal fins (labyrinth seal), so that the extension of the steam pipe due to the thermal expansion can be absorbed by the sliding movement of the seal fins.

These and other objects, features, and advantages of the present invention will be more apparent from in light of the detailed description of exemplary embodiments thereof as illustrated by the drawings.

BRIEF DESCRIPTION OF THE DRAWINGS

The accompanying drawings, which are incorporated in and constitute a part of the specification, illustrate an embodiment of the invention and together with the description serve to explain the principles of the invention. In the drawings, the same reference numerals indicate the same parts.

DESCRIPTION OF THE PREFERRED EMBODIMENTS

Before proceeding to a detailed description of the preferred embodiments, a prior art will be described with reference to the accompanying relating thereto for a clearer understanding of the differences between the prior art and the present invention.

Figure 12:
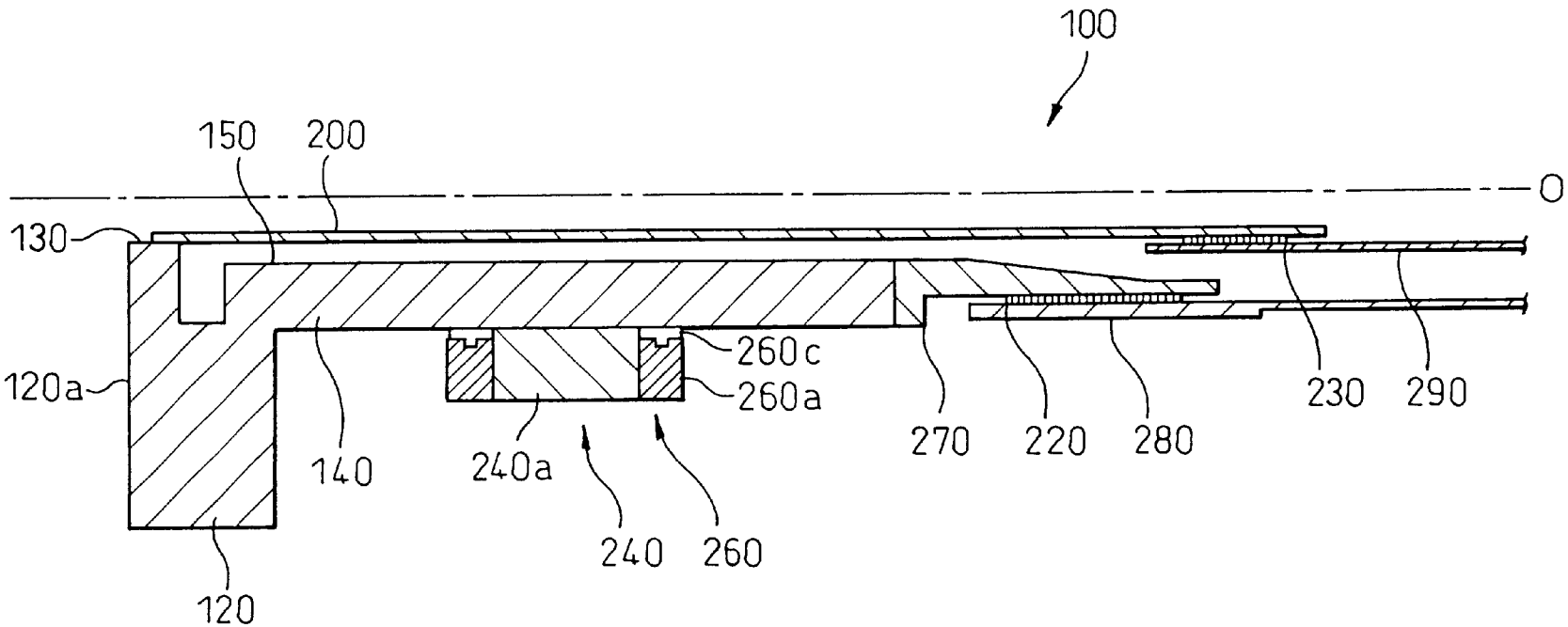
FIG. 12 is an axial sectional view of a half of a shaft portion of a rotor tail end according to a prior art.

FIG. 12 shows a known supply/recovery system of the cooling steam for rotor blades of a turbine.

The structure of the gas turbine rotor on the turbine side is completed by fastening a rotor tail end and a plurality of turbine disks.

To supply and recover the cooling steam to and from the blades embedded in the turbine disks, the rotor tail end is provided with a center hole to define a coaxial steam pipe.

The rotor tail end 100 is provided with a substantially circular disk portion 120 which defines an end disk and a substantially cylindrical hollow shaft portion 140. A disk center hole 130 and a rotor tail end center hole 150 extend along the central axis. The disk portion 120 is provided with a plurality of through holes (not shown) which are spaced from one another in the circumferential direction at an equal distance. A plurality of rotor blade disks (not shown) of the turbine are arranged in front of the disk portion 120 and, thereafter, turbine spindle bolts (not shown) are inserted in the through holes and fastened by nuts to form a rotor assembly in which the rotor blade disks (not shown) are supported and rotated together.

The disk center hole 130 of the rotor is provided with a steam passage member 200 welded thereto, through which the rotor blade cooling steam is supplied. A passage to recover the steam for cooling the rotor blade is defined between the inner surface of the central hole 150 of the rotor tail end extending from the rear end of the end disk of the rotor into the shaft portion 140 of the rotor and the steam passage member, so that the steam used to cool the rotor blades by means of an appropriate cooling device (not shown) can be recovered.

The connection between the rotating rotor tail end 100 and the stationary part is established as follows. For the inner tube, the steam passage member 200 is connected to a stationary inner steam pipe 290 through a seal fin (labyrinth seal) 230. Thereafter, a stationary short steam pipe 270 and an outer stationary steam pipe 280 are connected to the end of the rotor tail end 100 through a seal fin (labyrinth seal) 220. The seal fins 220 and 230 are connected to a leakage steam recovery instrument (not shown).

The rotor assembly thus obtained is rotatably supported at the rotor tail end 100 thereof by a bearing 240. The rotor blade cooling steam is produced by heating pressurized steam whose saturation temperature is approximately 140° C. to 400° C. or more, and is supplied through the passageway defined by the center hole of the rotor. Consequently, the rotor is heated to the saturation temperature of the cooling steam. However, in general, the tail end at which the bearing is provided is cooled by the lubricant to 100° C. or less than 100° C., so that thermal deformation of the tail end occurs due to a temperature difference between the central hole and the tail end.

The preferred embodiments of the present invention will be discussed below with reference to the drawings.

Figure 1:
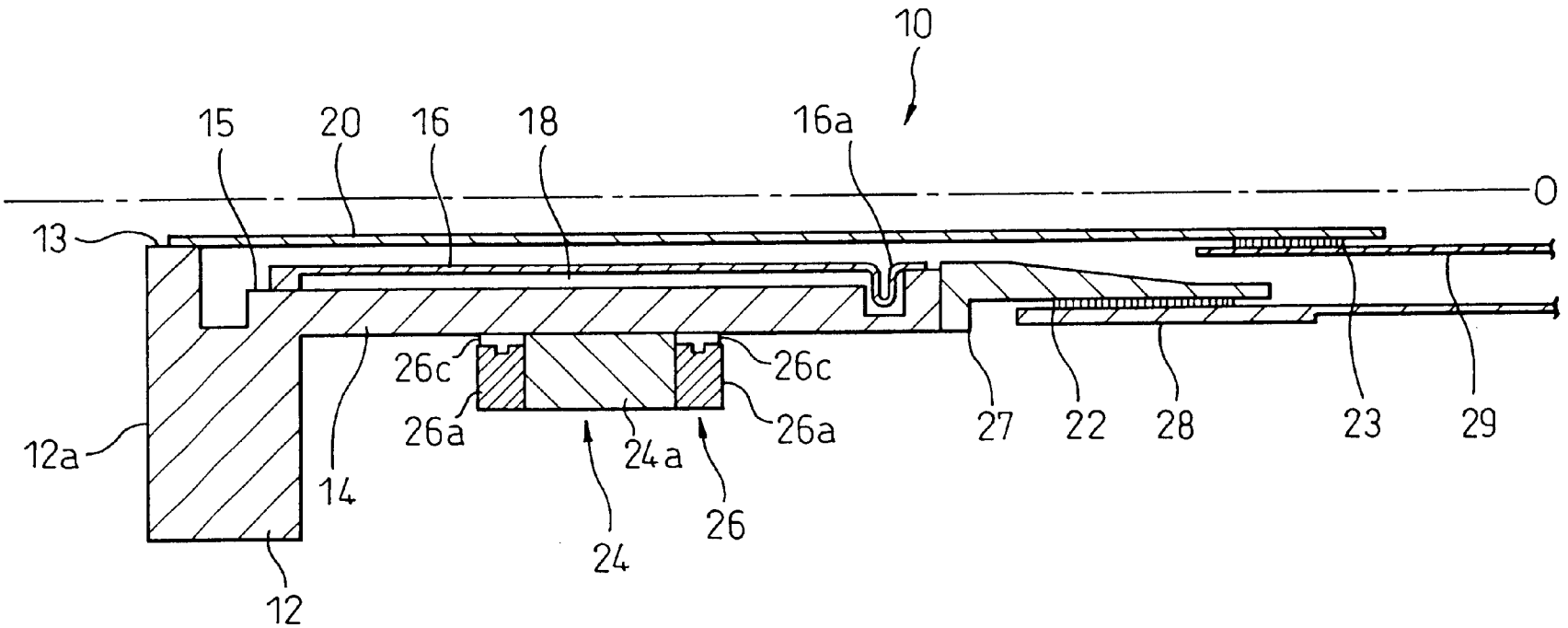
FIG. 1 is an axial sectional view of a half of a shaft portion of a rotor tail end according to a first embodiment of the present invention.

FIG. 1 shows a sectional view of a half of a tail end 10 of a rotor assembly of a gas turbine (which will be referred to merely as a rotator tail end), according to an embodiment of the invention. In the present specification, the compressor side of the gas turbine is referred to as a front side (left side in FIG. 1) and the expansion device side is referred to as a rear side (right side in FIG. 1).

The rotor tail end 10 includes an end disk 12 in the form of a substantially circular disk having a disk center hole 13 and a substantially cylindrical hollow shaft portion 14. A steam passage member 20 for supplying cooling steam is welded to the disk center hole 13. Moreover, the end disk 12 is provided with a plurality of through holes 12*b* (not shown) which are spaced at an equal distance in the circumferential direction about the center axis O in the longitudinal direction of the rotor assembly. Turbine spindle bolts (not shown) are inserted in the through holes 12*b* while the end disk 12 is in contact at its front end surface 12*a* with another disk (not shown) and the turbine spindle bolts are fastened by nuts (not shown), so that a rotor assembly which rotates as a unit, while supporting turbine rotor blades (not shown) is formed.

The rotor assembly constructed as above is rotatably supported at the rotor tail end 10 by a bearing 24. The bearing 24 is comprised of a bearing pad 24*a,* and seal portions 26 provided on opposite sides of the bearing pad 24*a.* As is well known in the art of the gas turbine, the bearing 24 forms a journal bearing. The seal portions 26 include brackets 26*a* which are adapted to mount seal members 26*c* to the bearing pad 24*a.*

The rotor tail end 10 is provided with a rotor tail end center hole 15 which is coaxial with the disk center hole 13 and whose diameter is greater than the diameter of the disk center hole 13. A cylindrical thermal sleeve 16 is inserted in the rotor tail end center hole 15. The front end of the thermal sleeve 16 (left end in FIG. 1) is welded to the rotor tail end center hole 15 and the rear end (right end in FIG. 1) is welded to the rear end of the shaft portion 14. The outer diameter of the thermal sleeve 16 is smaller than the inner diameter of the rotor tail end center hole 15 and a thermal insulation gas layer 18 is formed therebetween. Preferably, the thermal insulation gas layer 18 is filled with dry gas or inert gas such as air or argon.

The thermal sleeve 16 is provided on its rear end with a bent portion 16*a* which is adapted to absorb the thermal stress and in particular the compression stress when a temperature difference is caused between the shaft portion 14 and the thermal sleeve 16 whose temperature is increased in accordance with the operation of the gas turbine. More preferably, the thermal sleeve 16 is welded to the shaft portion 14 while the thermal sleeve is tensed in the axial direction so that a pre-tension is applied thereto. Consequently, when a temperature difference is caused between the thermal sleeve 16 and the shaft portion 14, in accordance with operation of the gas turbine, the compression stress can be reduced.

In the illustrated embodiment, the thermal sleeve 16 is inserted between the steam passage member 20 and the shaft portion 14 so that the thermal insulation gas layer 18 is formed between the thermal sleeve 16 and the inner surface of the rotor tail end center hole 15 of the shaft portion 14. Consequently, when the gas turbine operates and the cooling steam for cooling the turbine rotor blades flows, the heat transfer to the shaft portion 14 is restricted, thus resulting in no or little thermal deformation of the shaft portion 14.

Moreover, if a thermal expansion difference occurs due to the temperature difference between the thermal sleeve 16 and the shaft portion 14 by the steam passing in the steam passage member 20 during the operation of the turbine, since the thermal sleeve 16 is welded to the shaft portion 14 with a pre-tension, the thermal stress caused in the thermal sleeve 16 is reduced and thus the deformation thereof can be prevented. Moreover, since the thermal sleeve 16 is provided with the bent portion 16*a* at the rear end thereof, the thermal stress which cannot be absorbed by the application of the pre-tension can be absorbed by the deformation of the bent portion 16*a.* Thus, deformation of the cylindrical portion of the thermal sleeve 16 can be avoided. Moreover, the thermal insulation gas layer 18 is isolated gas-tightly and liquid-tightly from the outside, so that no steam can enter from the outside. Moreover, since the thermal insulation gas layer 18 is filled with a dry gas, no drain due to the condensation of the steam occurs even if the temperature drops during the stoppage of the gas turbine.

Figure 2:
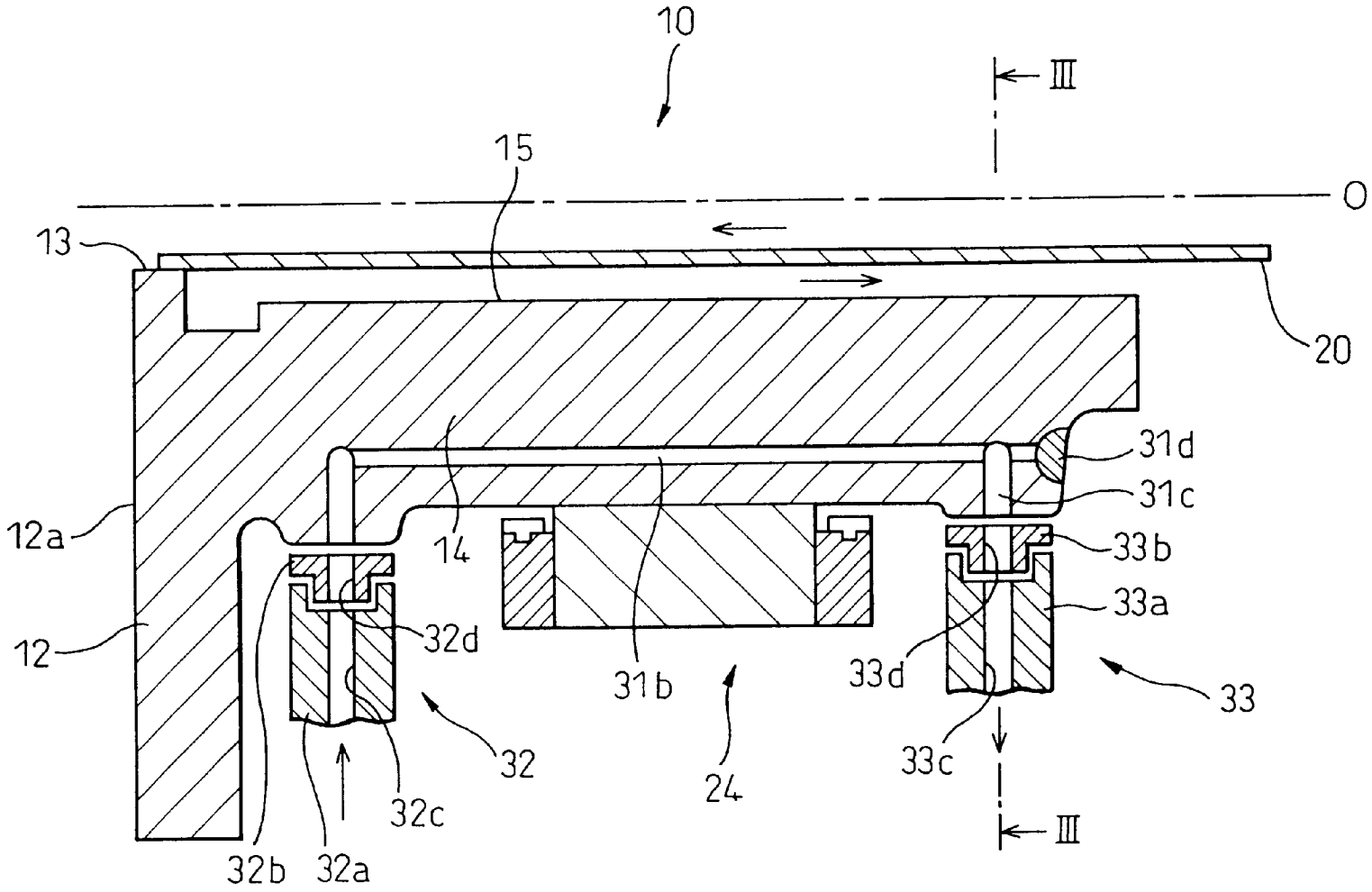
FIG. 2 is an axial sectional view of a half of a shaft portion of a rotor tail end according to a second embodiment of the present invention.
Figure 3:
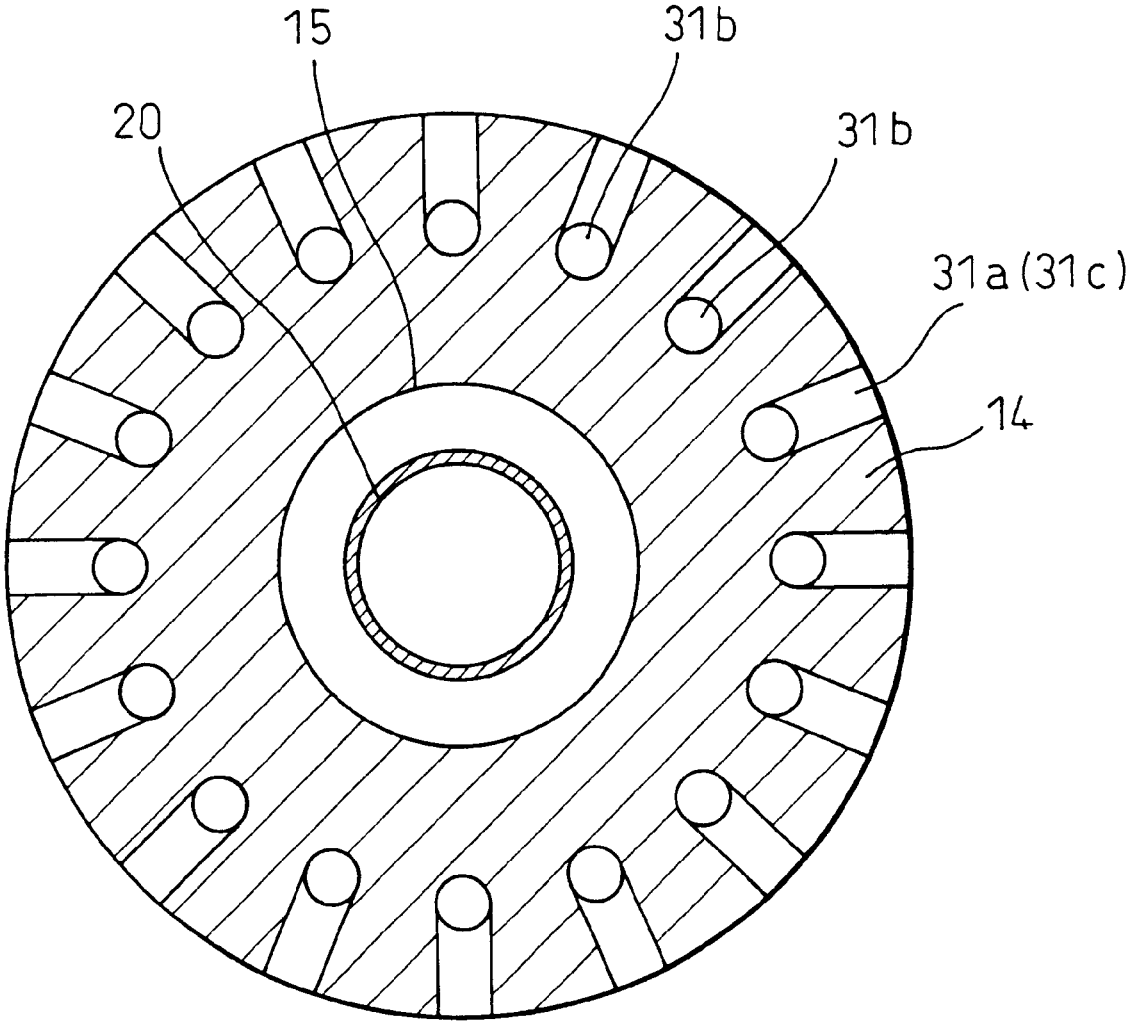
FIG. 3 is a sectional view taken along the line III—III in FIG. 2 and perpendicular to the shaft.

FIGS. 2 and 3 shows a second embodiment of the invention.

The rotor tail end 10 according to the second embodiment of the invention is comprised of a substantially circular disk portion 12 which forms an end disk and a substantially cylindrical hollow shaft portion 14. A disk center hole 13 of a rotor and a rotor tail end center hole 15 are also formed in the rotor tail end along the longitudinal center axis O. The rotor tail end center hole 15 is coaxial to the disk center hole 13 and has a diameter greater than the diameter of the disk center hole 13. Like the end disk 12 in the first embodiment, the disk portion 12 is provided with a plurality of through holes (not shown) which are spaced at an equal distance in the circumferential direction about the center axis O. Turbine spindle bolts (not shown) are inserted in the through holes while the disk portion 12 is in contact at its front end surface 12*a* with another disk (not shown) and the turbine spindle bolts are fastened by nuts (not shown), so that a rotor assembly which supports the turbine rotor blades (not shown) and rotates together therewith is formed. A steam passage member 20 is provided in the rotor disk center hole 13 to form a passage for the steam for cooling the turbine rotor blades. The inner surface of the rotor tail end center hole 15 of the shaft portion 14 of the rotor and the steam passage member 20 define therebetween a passage for recovering the steam for cooling the turbine rotor blades. The rotor assembly constructed as above is rotatably supported at the tail end 10 by the bearing 24 as in the first embodiment.

The shaft portion 14 is provided with a plurality of shaft portion cooling air passages comprised of radially extending cooling air inlet passages 31*a,* axially extending main air passages 31*b,* and radially extending cooling air outlet passages 31*c.* The shaft portion cooling air passages are spaced at an equal distance in the circumferential direction about the center axis O. The main air passages 31*b* can be formed, for example, by drilling the rotor at the end thereof to form axially extending blind holes and thereafter closing the open ends of the blind holes by welds 31*d.*

A cooling air introduction device 32 is provided to face the cooling air inlet passages 31*a.* The cooling air introduction device 32 is comprised of an air introduction passage 32*a* provided on a stationary part of the gas turbine, such as a casing (not shown), and a seal portion 32*b* provided on the inner circumferential surface of the air introduction portion 32*a.* The air introduction portion 32*a* and the seal portion 32*b* are respectively provided with air passages 32*c* and 32*d* which are connected to the cooling air inlet passages 31*a* and which are spaced at an equal distance in the circumferential direction, so that the cooling air supplied from the cooling air supply source (not shown) can be introduced into the cooling air inlet passages 31*a.*

Likewise, a cooling air discharge device 33 is provided to face the cooling air outlet passages 31*c.*The cooling air discharge device 33 is comprised of an air discharge portions 33*a* provided on the stationary part of the gas turbine, such as the casing (not shown), and a seal portion 33*b* provided on the inner circumferential surface of the air discharge portion 33*a.* The air discharge portion 33*a* and the seal portion 33*b* are respectively provided with a plurality of air passages 33*c* and 33*d* which are connected to the cooling air discharge passages 31*c* and which are spaced at an equal distance in the circumferential direction. The air from the cooling air introduction device 32 is fed to a plurality of shaft portion cooling air passages 31*a,* 31*b* and 31*c* to cool the rotor tail end 10 and is discharged to the outside of the gas turbine.

In the illustrated embodiment, since the shaft portion 14 is provided with a plurality of shaft portion cooling air passages 31*a,* 31*b* and 31*c* in which the cooling air passes, when the turbine rotor blade cooling steam flows in the steam passage member 20 in accordance with the operation of the gas turbine, the shaft portion 14 is cooled at the portion thereof in the vicinity of the surface by the cooling air which passes in the shaft portion cooling air passages 31*a,* 31*b* and 31*c* and, thus, a thermal deformation of the shaft portion 14 can be minimized or restricted.

Figure 4:
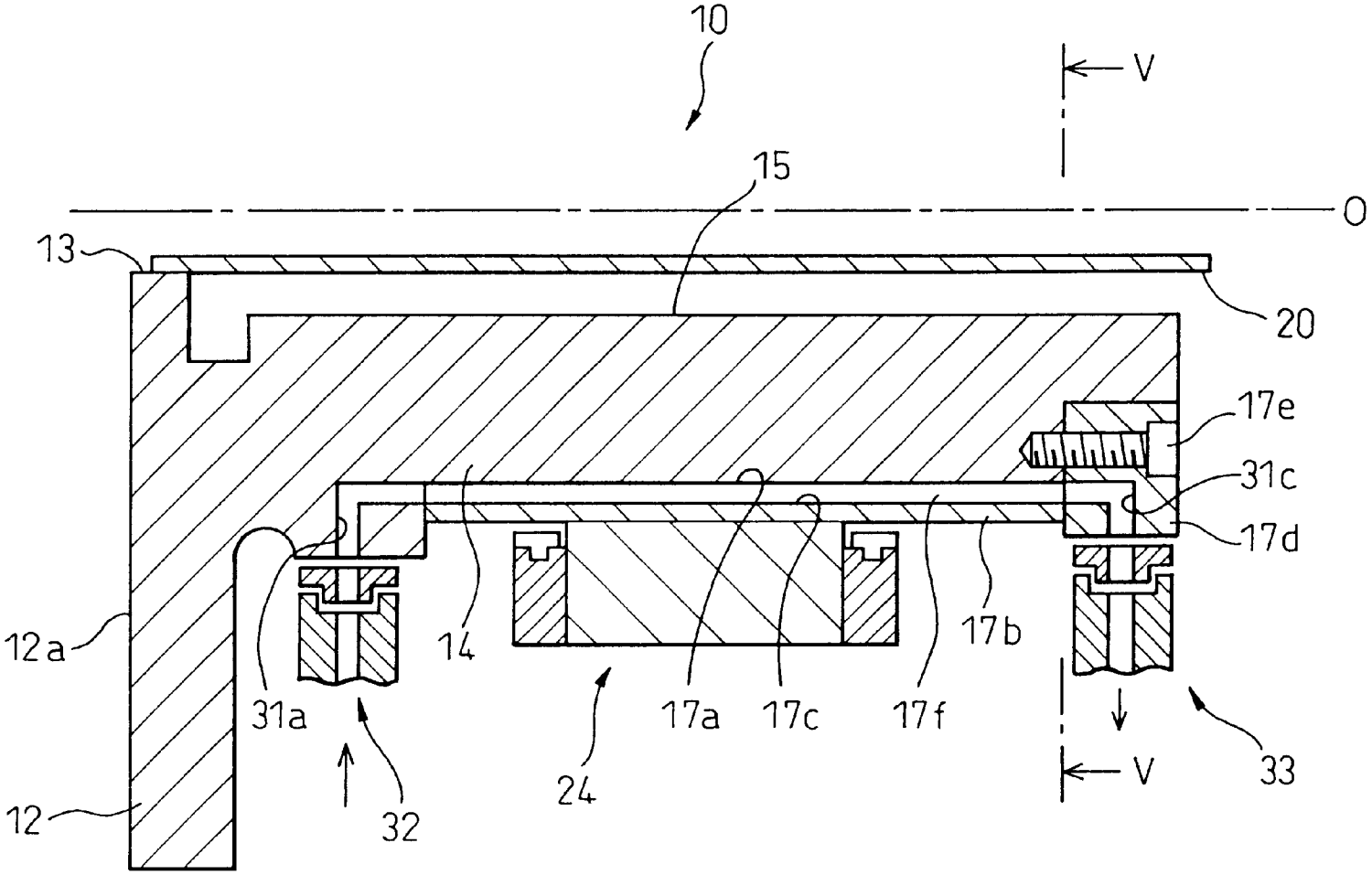
FIG. 4 is an axial sectional view of a half of a shaft portion of a rotor tail end according to a third embodiment of the present invention.
Figure 5:
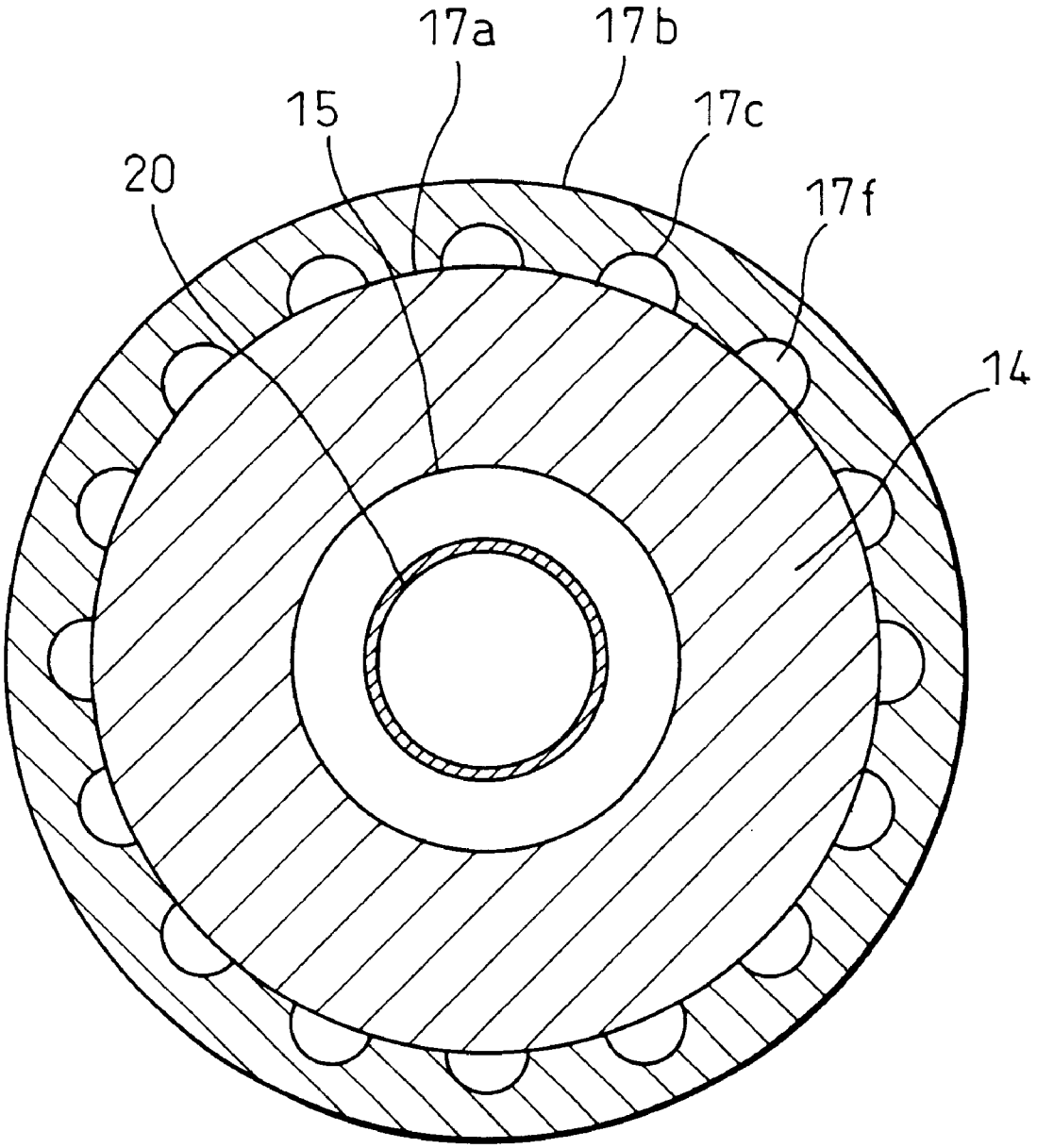
FIG. 5 is a sectional view taken along the line V—V in FIG. 4 and perpendicular to the axis of a sleeve.

A third embodiment of the invention is shown in FIGS. 4 and 5.

In the second embodiment mentioned above, a plurality of shaft portion cooling air passages 31*a,* 31*b* and 31*c* are formed by directly drilling the shaft portion 14. In the third embodiment, however, the shaft portion cooling air passages are formed between the outer peripheral surface of the shaft body portion and the sleeve by fitting a sleeve on an outer surface of the shaft body portion of the rotor tail end.

Referring to FIGS. 4 and 5, the rotor tail end 10 of the third embodiment is comprised of a substantially circular disk portion 12 which defines an end disk, a substantially cylindrical hollow shaft body portion 14, and a sleeve 17 which is fitted on the shaft body portion 14. The tail end center hole 15 of the rotor is formed to extend along the longitudinal center axis O. Like the previous embodiments, a rotor assembly is formed and is rotatably supported by a bearing 24 similar to that in the previous embodiments at the rotor tail end 10. Namely, the shaft body portion 14 and the sleeve 17 fitted thereon define the shaft portion in the previous embodiments.

The sleeve 17 is comprised of a substantially cylindrical member having an inner peripheral surface 17*a* having an inner diameter equal to the diameter of the shaft portion 14, and an outer peripheral surface 17*b* having an outer diameter equal to shaft portion of the rotor assembly which is rotatably supported by the bearing 24. The inner peripheral surface 17*a* is provided with a plurality of axially extending semi-circular grooves 17*c.* The sleeve 17 is fitted on the outer peripheral surface of the shaft body portion 14 and, thereafter, the annular end plate 17*d* is secured to the end of the shaft body portion 14 by means of bolts 17*e.* The end plate 17*d* is provided with a plurality of cooling air outlet passages 31*c* which can be connected to main air passages 17*f* formed between the outer peripheral surface of the shaft body portion 14 and the grooves 17*c* of the sleeve 17, when assembled as shown in FIG. 4. The shaft portion 14 is provided with a plurality of cooling air inlet passages 31*a* in the vicinity of the proximal end thereof, which can be connected to the main air passages 17*f.* The cooling air inlet passages 31*a,* the main air passages 17*f* and the cooling air outlet passages 31*c* form a plurality of shaft portion cooling air passages. The shaft portion cooling air passages 31*a,* 17*f,* and 31*c* are spaced at an equal distance in the circumferential direction with respect to the center axis O.

Like the second embodiment, a cooling air introduction device 32 is provided to face the cooling air inlet passages 31*a* and a cooling air discharge device 33 is provided to face the cooling air outlet passages 31*c.* The air from the cooling air introduction device 32 is fed to the shaft portion cooling air passages 31*a,* 17*f* and 31*c* to cool the rotor tail end 10 and is discharged to the outside of the gas turbine.

In this embodiment, since the shaft portion cooling air passages 31*a,* 17*f* and 31*c* in which the cooling air can be passed are formed between the shaft body portion 14 and the sleeve 17, the sleeve 17 which forms a part of the shaft portion of the rotor tail end is cooled when the rotor blade cooling steam is fed in the steam passage member 20 in accordance with the operation of the gas turbine. Consequently, the thermal deformation of the shaft portion is minimized or restricted.

Figure 6:
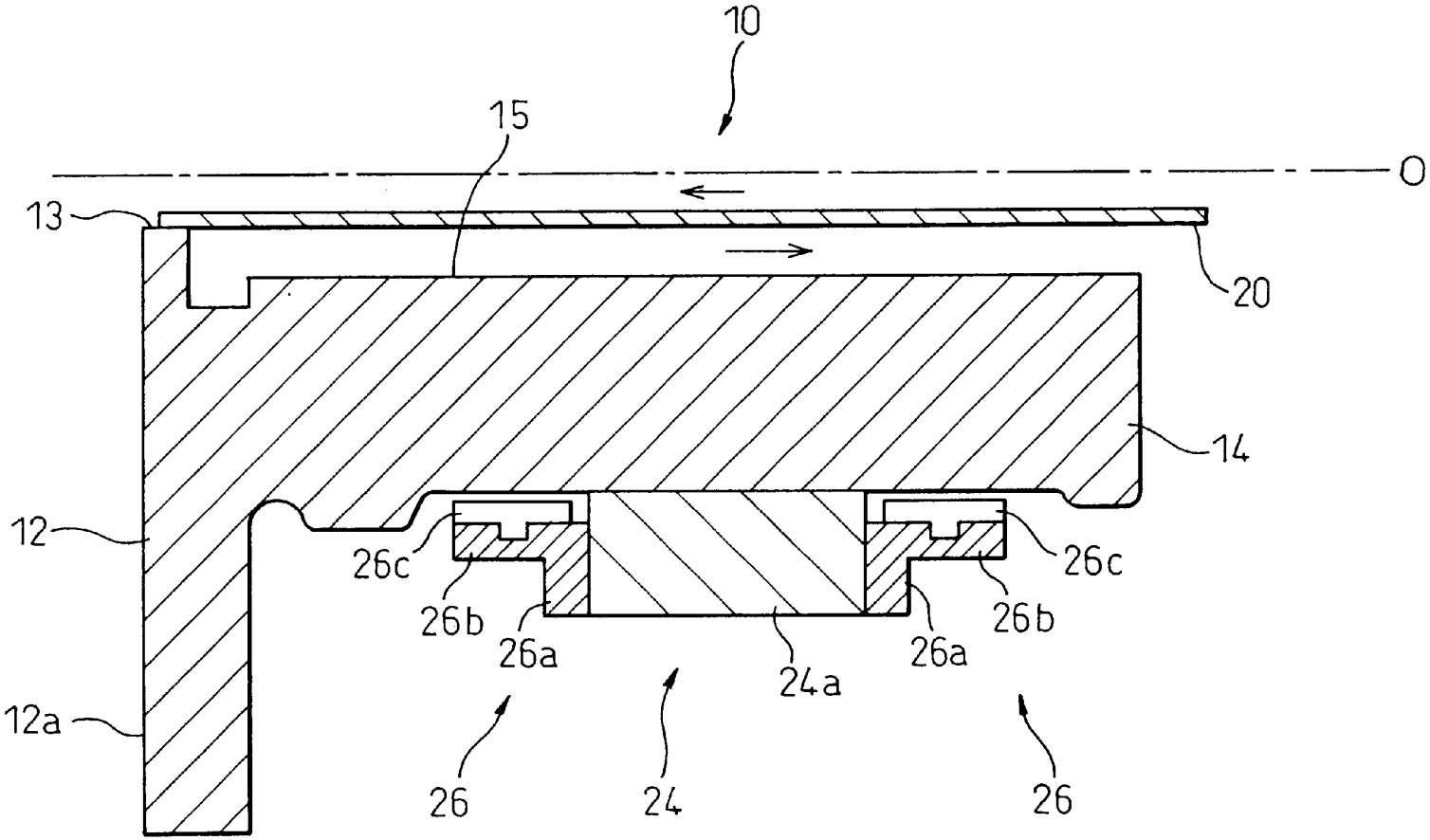
FIG. 6 is an axial sectional view of a half of a shaft portion of a rotor tail end according to a fourth embodiment of the present invention.
Figure 7:
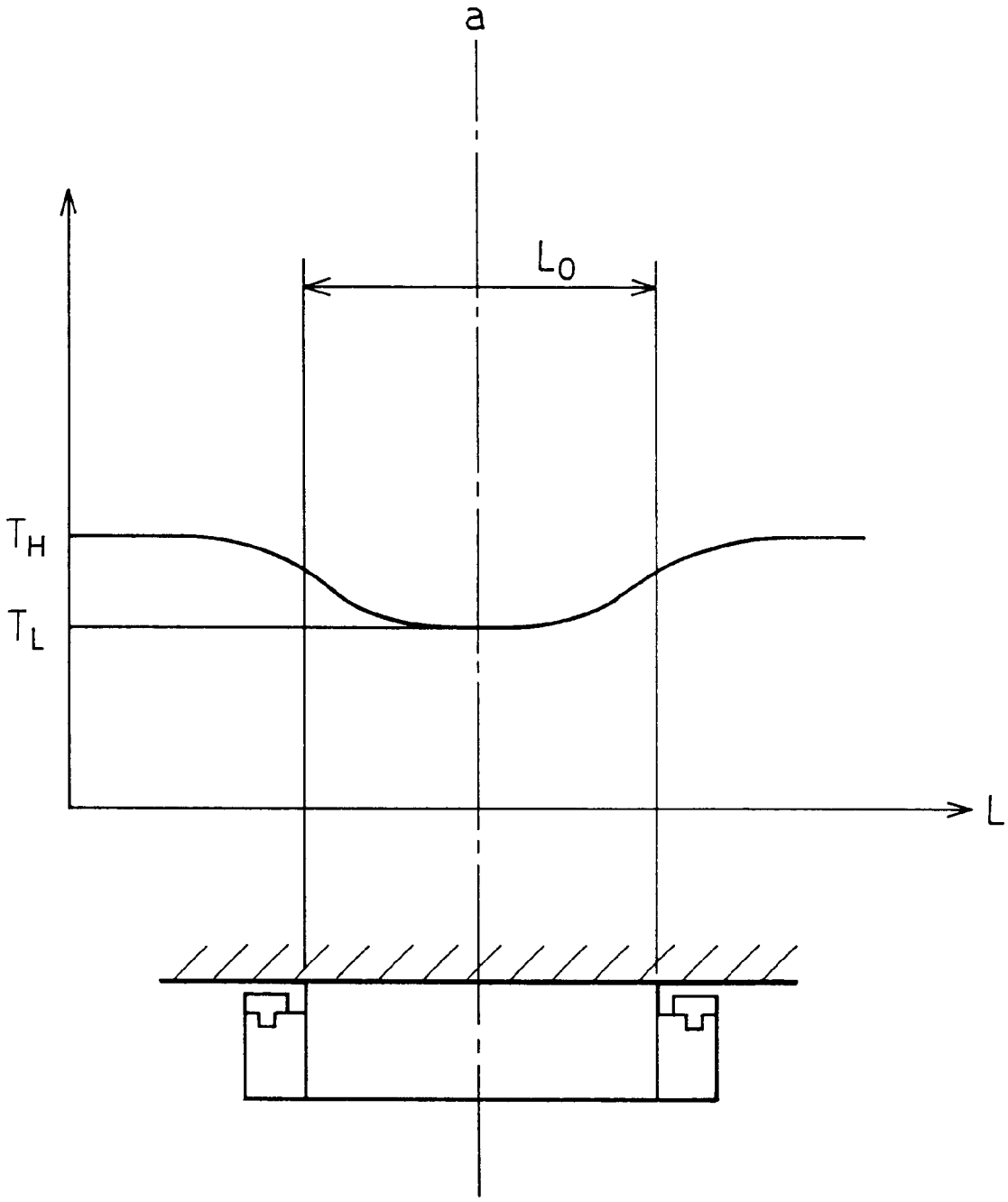
FIG. 7 is a schematic view of thermal deformation of a shaft portion of a rotor tail end, which is the drawback of the prior art.
Figure 8:
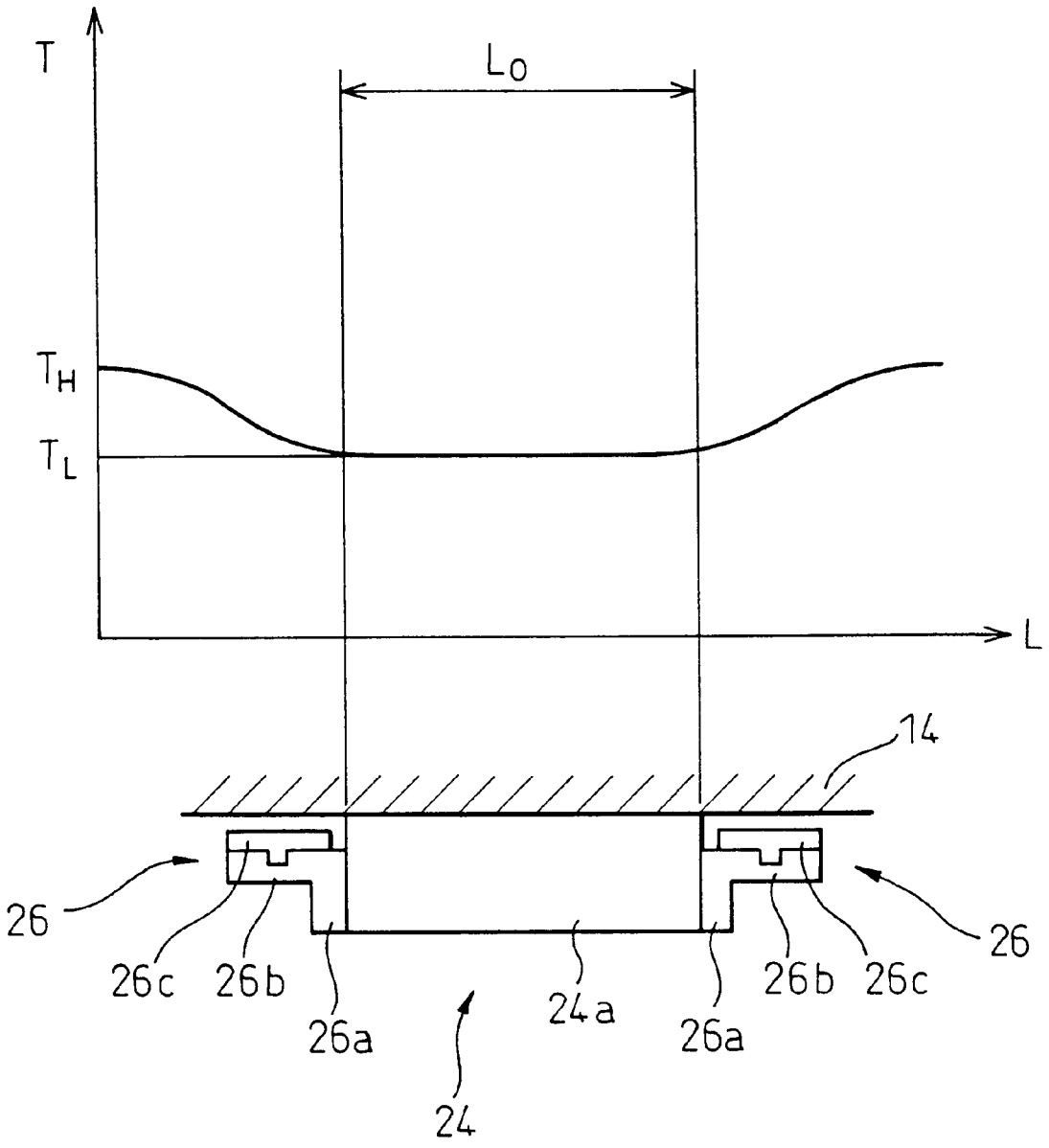
FIG. 8 is a schematic view of thermal deformation of a shaft portion of a rotor tail end when the fourth embodiment of the invention is applied.

FIGS. 6 through 8 shows a fourth embodiment of the present invention.

In FIG. 6, the rotor tail end 10 of the fourth embodiment is comprised of a substantially circular disk portion 12 which defines an end disk, and a substantially cylindrical hollow shaft portion 14. The disk center hole 13 of the rotor and the rotor tail end center hole 15 are formed to extend along the longitudinal center axis O. The rotor tail end center hole 15 is coaxial to the disk center hole 13 and has a diameter greater than the diameter of the disk center hole 13. Like the end disk 12 in the first embodiment, the disk portion 12 is provided with a plurality of through holes (not shown) which are spaced at an equal distance in the circumferential direction about the center axis O. Turbine spindle bolts (not shown) are inserted in the through holes while the disk portion 12 is in contact at its front end surface 12*a* with another disk (not shown), the turbine spindle bolts are fastened by nuts (not shown), so that a rotor assembly which supports the turbine rotor blades (not shown) and rotates together therewith is formed. A steam passage member 20 is provided in the rotor disk center hole 13 to form a passage for the steam for cooling the turbine rotor blades. The inner surface of the rotor tail end center hole 15 of the shaft portion 14 of the rotor and the steam passage member define therebetween a passage for recovering the steam for cooling the turbine rotor blades. The rotor assembly constructed as above is rotatably supported at the tail end 10 by the bearing 24.

The bearing 24 in this embodiment is comprised of a bearing pad 24*a* and seal portions 26 provided on opposite sides of the bearing pad 24*a*. The seal portions 26 include seal members 26*c* and brackets to mount the seal members 26*c* to the bearing pad 24*a*. The brackets include radial securing portions 26*a* mounted to the bearing pad 24*a* and ledges 26*b* connected to the radial securing portions 26*a*, so that the brackets are L-shaped in a cross section. In this embodiment, the seal members 26*c* are greater in the width, i.e. in the size in the axial direction, than those of the embodiments illustrated in FIGS. 1 through 5. Accordingly, the brackets of the bearing 24 are provided with the ledges 26*b* which extend in the axial direction, unlike the previous embodiments shown in FIGS. 1 through 5.

As mentioned above, in a journal bearing which is commonly used in a gas turbine, the bearing pad is provided with an oil passage (not shown) extending therethrough in the radial direction, so that a lubricant is supplied through the oil passage to lubricate the gap between the shaft portion of the rotor assembly and the bearing and to cool the gap between the shaft portion and the bearing pad. The seal member reduces the leakage of lubricant from the gap between the shaft portion and the bearing pad, so that the lubrication between the shaft portion and the bearing pad can be promoted. However, in a conventional journal bearing, the width of the seal portion in the axial direction is insufficient and, hence, the distribution of temperature T of the outer surface of the shaft portion in the axial direction exhibits a constant low temperature TL at the center area "a" of the bearing pad which is cooled by the lubricant and forms asymptotes approaching a constant high temperature TH symmetrically on both sides of the area "a" in the axial directions away from the center area "a". Consequently, a thermal deformation analogous to the temperature distribution shown in FIG. 7 occurs in the shaft portion, so that the gap between the shaft portion and the bearing pad is made excessively narrow or the shaft portion and the bearing pad interfere with or touch each other.

In the fourth embodiment of the present invention, the seal members 26*c* which are greater in width in the axial direction than the seal members of the prior art is used to resolve the problems of the prior art mentioned above. Namely, the seal members 26*c* must be long enough to maintain the surface temperature of the shaft portion 14 at the constant low temperature TL, in the area of the axial length L0 of the bearing pad 24*a*, i.e., in the surface area of the shaft portion 14 opposed to the bearing pad. With the seal members having the width in the axial direction so as to cool the shaft portion 14 over the broader range in the axial direction than the prior art, it is possible to prevent the gap between the shaft portion 14 and the bearing pad 24*a* from being made excessively small, or it is possible to reduce the thermal deformation of the shaft portion 14, whereby no interference or no contact of the shaft portion with the bearing pad 24*a* takes place.

Figure 9:
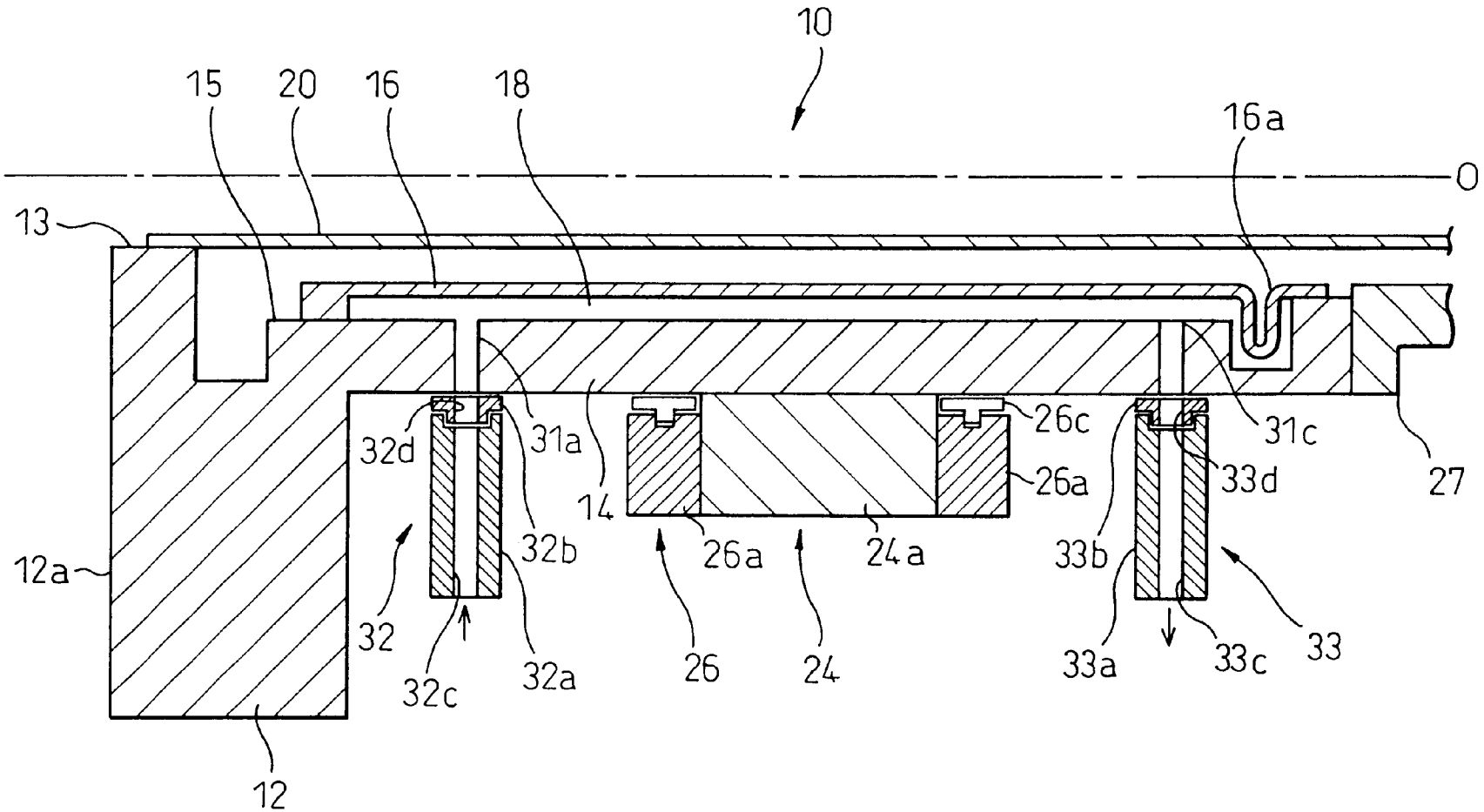
FIG. 9 is an axial sectional view of a half of a shaft portion of a rotor tail end according to a fifth embodiment of the present invention.

A fifth embodiment of the present invention will be discussed below with reference to FIG. 9.

The rotor tail end 10 is comprised of a substantially circular end disk 12 having a disk center hole 13, and a substantially cylindrical hollow shaft portion 14. A cooling steam supply passage member 20 is welded to the disk center hole 13. The end disk 12 is provided with a plurality of through holes 12*b* (not shown) which are spaced at an equal distance in the circumferential direction about the longitudinal center axis O of the rotor assembly. Turbine spindle bolts (not shown) are inserted in the through holes while the disk portion 12 is in contact at its front end surface 12*a* with another disk (not shown), and the turbine spindle bolts are fastened by nuts (not shown), so that a rotor assembly which supports the turbine rotor blades (not shown) and rotates together therewith is formed.

The rotor assembly thus obtained is rotatably supported at the tail end 10 by the bearing 24. The bearing 24 is comprised of a bearing pad 24*a* and seal portions 26 on opposite sides of the bearing pad 24*a*. The bearing 24 forms a journal bearing as is well known in the field of gas turbines. The seal portions 26 include brackets 26*a* to mount the seal members 26*c* to the bearing pad 24*a*.

A cylindrical thermal sleeve 16 is inserted in the rotor tail end center hole 15 of the rotor tail end 10. The rotor tail end center hole 15 is coaxial to the disk center hole 13 and has a diameter greater than the diameter of the disk center hole 13. The front end of the thermal sleeve 16 (left end in FIG. 9) is welded to the rotor tail end center hole 15 and the rear end (right end in FIG. 9) thereof is welded to the rear end of the shaft portion 14. The thermal sleeve 16 has an outer diameter smaller than the inner diameter of the rotor tail end center hole 15 of the shaft portion 14, so that a thermal insulation gas layer 18 is formed therebetween.

The thermal sleeve 16 is provided on its rear end with a bent portion 16*a* which is adapted to absorb the thermal stress and in particular the compression stress when a temperature difference is caused between the shaft portion 14 and the thermal sleeve 16 whose temperature is increased in accordance with the operation of the gas turbine. More preferably, the thermal sleeve 16 is welded to the shaft portion 14 while the thermal sleeve is tensed in the axial direction so that a pre-tension is applied thereto. Consequently, when a temperature difference is caused between the thermal sleeve 16 and the shaft portion 14, in accordance with the gas turbine, the compression stress can be reduced.

The shaft portion 14 is provided with a plurality of shaft portion cooling air passages which are comprised of radially extending cooling air inlet passages 31*a* and cooling air outlet passages 31*c* and which are connected to the thermal insulation gas layer 18 to form a cooling air passageway.

A cooling air introduction device 32 is provided to face the cooling air inlet passages 31*a*. The cooling air introduction device 32 is comprised of an air introduction portion 32*a* provided on a stationary part of the gas turbine, such as a casing (not shown), and a seal member 32*b* provided on the inner surface of the air introduction portion 32*a*. The air introduction portion 32*a* and the seal member 32*b* are respectively provided with a plurality of air passages 32*c* and 32*d* which are connected to the cooling air inlet passages 31*a* and which are spaced at an equal distance in the circumferential direction, so that the cooling air supplied from the cooling air supply source (not shown) can be introduced into the cooling air inlet passages 31*a*.

Likewise, a cooling air discharge device 33 is provided to face the cooling air outlet passages 31*c*. The cooling air discharge device 33 is comprised of an air discharge portion 33*a* provided on the stationary part of the gas turbine, such as the casing, and a seal member 33*b* provided on the inner surface of the air discharge portion 33*a*. The air discharge portion 33*a* and the seal portion 33*b* are respectively provided with a plurality of air passages 33*c* and 33*d* which are connected to the cooling air outlet passages 31*c* and which are spaced at an equal distance in the circumferential direction. The air from the cooling air introduction device 32 is fed to the shaft portion cooling air passages 31*a,* 18 and 31*c* to cool the rotor tail end 10 and is discharged to the outside of the gas turbine.

In the illustrated embodiment, since the shaft portion 14 is provided with a plurality of shaft portion cooling air passages 31*a,* 18 and 31*c* in which the cooling air can be passed, when the turbine rotor blade cooling steam flows in the steam passage member 20 in accordance with the operation of the gas turbine, the bearing region of the shaft portion 14 is cooled by the cooling air which passes in the shaft portion cooling air passages 31*a,* 18 and 31*c* and, thus, a thermal deformation of the shaft portion 14 can be reduced or restricted.

Figure 10:
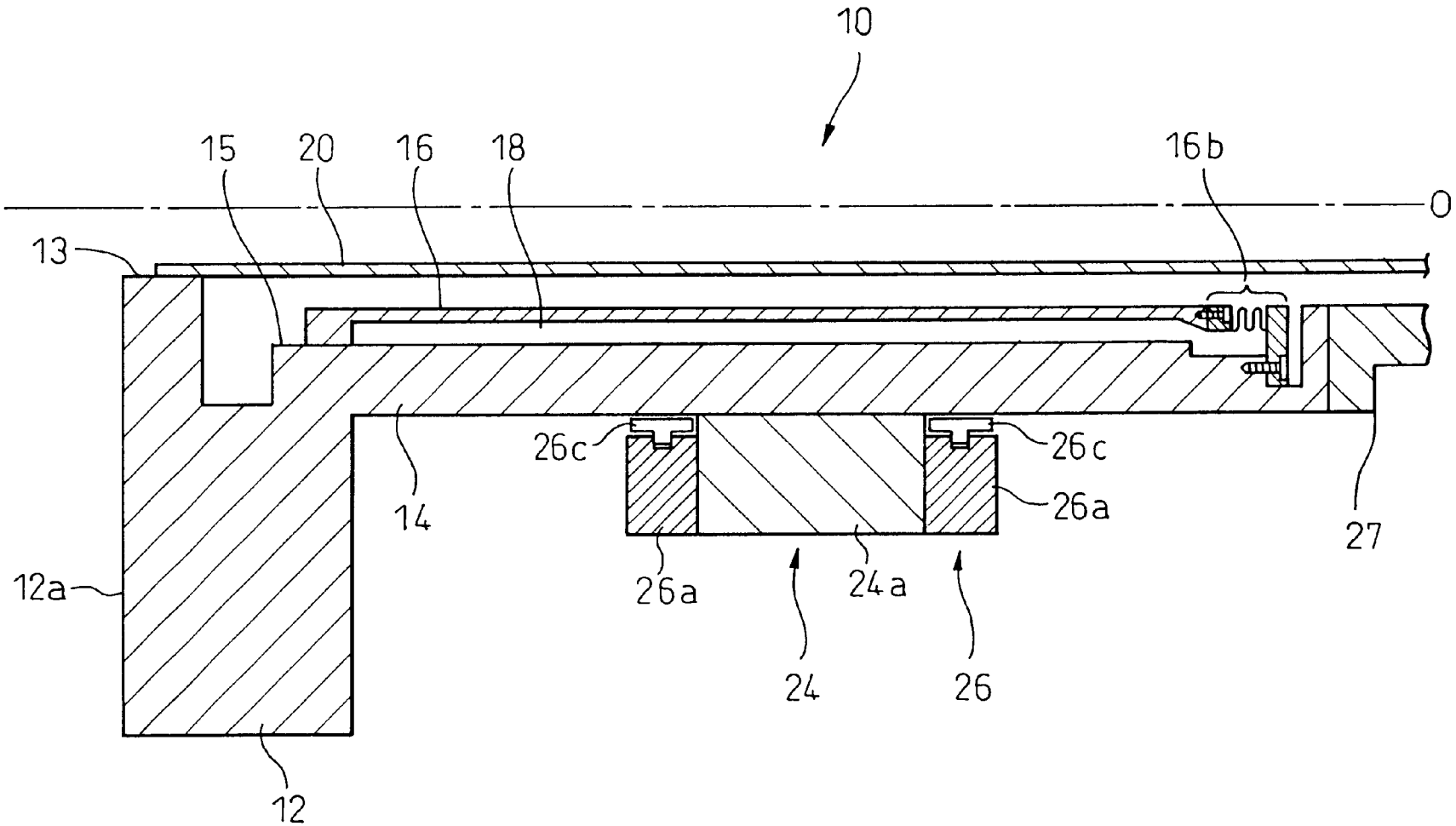
FIG. 10 is an axial sectional view of a half of a shaft portion of a rotor tail end according to a sixth embodiment of the present invention.

A sixth embodiment of the present invention will be discussed below with reference to FIG. 10.

The rotor tail end 10 is comprised of a substantially circular end disk 12 having a disk center hole 13, and a substantially cylindrical hollow shaft portion 14. A cooling steam supply passage member 20 is welded to the disk center hole 13. The end disk 12 is provided with a plurality of through holes 12*b* (not shown) which are spaced at an equal distance in the circumferential direction about the longitudinal center axis O of the rotor assembly. Turbine spindle bolts (not shown) are inserted in the through holes while the disk portion 12 is in contact at its front end surface 12*a* with another disk (not shown), and the turbine spindle bolts are fastened by nuts (not shown), so that a rotor assembly which supports the turbine rotor blades (not shown) and rotates together therewith is formed.

The rotor assembly thus obtained is rotatably supported at the tail end 10 by the bearing 24. The bearing 24 is comprised of a bearing pad 24*a* and seal portions 26 on opposite sides of the bearing pad 24*a*. The bearing 24 forms a journal bearing as is well known in the field of gas turbines. The seal portions 26 are provided with brackets 26*a* to mount the seal members 26*c* to the bearing pad 24*a*.

A cylindrical thermal sleeve 16 is inserted in the rotor tail end center hole 15 of the rotor tail end 10. The rotor tail end center hole 15 is coaxial to the disk center hole 13 and has a diameter greater than the diameter of the disk center hole 13. The front end of the thermal sleeve 16 (left end in FIG. 10) is welded to the rotor tail end center hole 15 and the rear end (right end in FIG. 10) thereof is welded to the rear end of the shaft portion 14. The thermal sleeve 16 has an outer diameter smaller than the inner diameter of the rotor tail end center hole 15 of the shaft portion 14, so that a thermal insulation gas layer 18 is formed therebetween.

The thermal sleeve 16 is provided on its rear end with a bellows 16*b* which is adapted to absorb the thermal stress and in particular the compression stress when a temperature difference is caused between the shaft portion 14 and the thermal sleeve 16 whose temperature is increased in accordance with the operation of the gas turbine. The bellows 16*b* is provided on its ends with flanges which are in turn provided with holes in which mounting bolts are inserted to mount the bellows 16*b* to the thermal sleeve 16 and the shaft. Thus, the bellows can be easily manufactured and the maintenance of the bellows can be facilitated. Moreover, as can be seen in the drawings, seal members, such as O-rings or C-seal members (not shown) are provided between the flanges of the bellows and the thermal sleeve and between the flanges of the bellows and the shaft to more reliably insulate the thermal insulation gas layer 18 in the gas-tightly and liquid-tightly from the outside.

Figure 11:
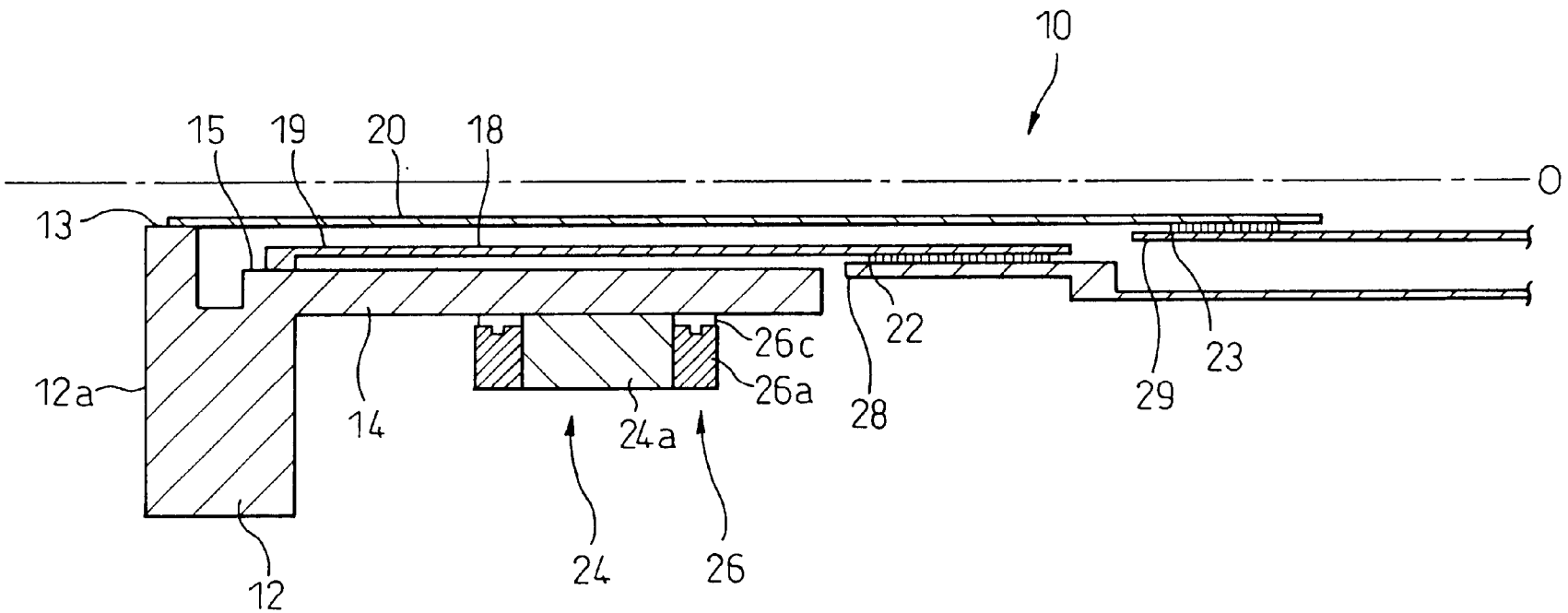
FIG. 11 is an axial sectional view of a half of a shaft portion of a rotor tail end according to a seventh embodiment of the present invention.

A seventh embodiment of the present invention will be discussed below with reference to FIG. 11.

The rotor tail end 10 is comprised of a substantially circular end disk 12 having a disk center hole 13, and a substantially cylindrical hollow shaft portion 14. A cooling steam supply passage member 20 is welded to the disk center hole 13. The end disk 12 is provided with a plurality of through holes 12*b* (not shown) which are spaced at an equal distance in the circumferential direction about the longitudinal center axis O of the rotor assembly. Turbine spindle bolts (not shown) are inserted in the through holes while the disk portion 12 is in contact at its front end surface 12*a* with another disk (not shown), and the turbine spindle bolts are fastened by nuts (not shown), so that a rotor assembly which supports the turbine rotor blades (not shown) and rotates together therewith is formed.

The rotor assembly thus obtained is rotatably supported at the tail end 10 by the bearing 24. The bearing 24 is comprised of a bearing pad 24*a* and seal portions 26 on opposite sides of the bearing pad 24*a*. The bearing 24 forms a journal bearing as is well known in the field of gas turbines. The seal portions 26 are provided with brackets 26*a* to mount the seal members 26*c* to the bearing pad 24*a*.

An outer steam pipe 19 is inserted in the rotor tail end center hole 15 of the rotor tail end 10. The rotor tail end center hole 15 is coaxial to the disk center hole 13 and has a diameter greater than the diameter of the disk center hole 13. The front end of the outer steam pipe 19 (left end in FIG. 11) is welded to the rotor tail end center hole 15 and the rear end (right end in FIG. 11) thereof is inserted through a seal fin (outer pipe) 22 provided on a stationary steam pipe (outer pipe) 28. Like the prior art (FIG. 12), the left end of the steam passage member 20 is welded to the disk center hole 13 of the end disk 12 and the right end thereof is inserted in the inner stationary steam pipe 29 through a seal fin (inner pipe) 23. The steam passage member 20 and the outer steam pipe 19 are rotatable and extendable due to the seal fins 22 and 23. The leakage of steam from the seal fins 22 and 23 is recovered by recovery equipment (not shown). In this embodiment, the outer steam pipe 19 serves as a thermal sleeve to restrict the overheating of the shaft portion 14 of the rotor and the extension and contraction due to the temperature difference of the steam pipes is absorbed by the seal fins.

Although the invention has been shown and described with exemplary embodiments thereof, it should be understood by those skilled in the art that the foregoing and various other changes, omissions and additions may be made therein and thereto without departing from the spirit and the scope of the invention.

What is claimed is:

1. A shaft structure of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a rotor tail end in which a center hole of the rotor tail end coaxial to the center axis of the steam passage is formed;

a thermal sleeve provided between the steam passage and an inner surface of the center hole of the rotor tail end; and a thermal insulation gas layer formed between the inner surface of the center hole of the rotor tail end and the thermal sleeve;

the thermal insulation gas layer being isolated gas-tightly and liquid-tightly from the outside, wherein said thermal sleeve is in the form of a substantially circular cylinder which is welded at its one end to an end disk of the gas turbine and welded at the other end to a shaft portion of the rotor tail end, said thermal sleeve being provided with a bent portion in the vicinity of the end thereof welded to the shaft portion of the rotor tail end, so that the bent portion reduces a thermal stress due to a thermal expansion of the thermal sleeve.

2. A shaft structure of a rotor tail end of a gas turbine according to claim 1, wherein a pre-tension is applied to the thermal sleeve when the latter is mounted to the end disk or the shaft portion.

3. A shaft structure of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a plurality of shaft portion cooling air passages formed between the steam passage and an outer surface of a shaft portion of the rotor tail end;

an air introduction portion provided on a stationary part of the gas turbine; and a seal member provided on an inner surface of the air introduction portion.

4. A shaft structure of a rotor tail end of a gas turbine according to claim 3, wherein said shaft portion cooling air passages are at least partly formed directly in the shaft portion.

5. A shaft structure of a rotor tail end of a gas turbine according to claim 3 or 4, wherein said shaft portion comprises a shaft body portion which surrounds the steam passage, and a sleeve fitted on an outer surface of the shaft body portion, and wherein said shaft portion cooling air passages includes a main air passage which is formed at least partly between the shaft body portion and the sleeve.

6. A bearing structure for bearing a shaft portion of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a bearing pad which forms a journal bearing; and seal portions provided on opposite sides of the bearing pad in an axial direction to prevent leakage of a lubricant for lubricating a space between the bearing pad and the shaft portion, a width of said seal portion in the axial direction being such that a surface temperature of the shaft portion of the rotor tail end is maintained below a predetermined temperature by the lubricant, within the width of the bearing pad in the axial direction.

7. A shaft structure of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a rotor tail end in which a center hole coaxial to the center axis of the steam passage is formed;

a thermal sleeve provided between the steam passage and an inner surface of the center hole of the rotor tail end;

a thermal insulation gas layer formed between the inner surface of the center hole of the rotor tail end and the thermal sleeve;

an air introduction portion provided on a stationary part of the gas turbine; and a seal member provided on an inner surface of the air introduction portion, wherein cooling air is circulated from the outside into the thermal insulation gas layer.

8. A shaft structure of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a rotor tail end in which a center hole coaxial to the center axis of the steam passage is formed;

a thermal sleeve provided between the steam passage and an inner surface of the center hole of the rotor tail end; and a thermal insulation gas layer formed between the inner surface of the center hole of the rotor tail end and the thermal sleeve;

cooling air being circulated from the outside into the thermal insulation gas layer, wherein said thermal sleeve is in the form of a substantially circular cylinder which is welded at its one end to an end disk of the gas turbine and is welded at the other end to a shaft portion of the rotor tail end through a bellows which reduces a thermal stress due to a thermal expansion of the thermal sleeve.

9. A shaft structure of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a first labyrinth seal through which the steam passage is connected to a stationary inner steam pipe;

a rotor tail end in which a center hole coaxial to the center axis of the steam passage is formed;

a steam pipe provided in the center hole of the rotor tail end;

a thermal insulation gas layer formed between an inner surface of the center hole of the rotor tail end and the steam pipe; and a second labyrinth seal through which the steam pipe is connected to a stationary outer steam pipe.

10. A shaft structure of a rotor tail end of a gas turbine, comprising:

a rotor assembly of the gas turbine having a center axis;

rotor blades of the gas turbine;

a steam passage extending along the center axis for supplying and recovering a steam for cooling the rotor blades;

a rotor tail end in which a center hole of the rotor tail end coaxial to the center axis of the steam passage is formed;

a thermal sleeve provided between the steam passage and an inner surface of the center hole of the rotor tail end; and a thermal insulation gas layer formed between the inner surface of the center hole of the rotor tail end and the thermal sleeve;

the thermal insulation gas layer being isolated gas-tightly and liquid-tightly from the outside, wherein said thermal sleeve is in the form of a substantially circular cylinder which is welded at its one end to an end disk of the gas turbine and is welded at the other end to a shaft portion of the rotor tail end through a bellows which reduces a thermal stress due to a thermal expansion of the thermal sleeve.

* * * * *